US006240868B1

(12) United States Patent
Fitzpatrick et al.

(10) Patent No.: US 6,240,868 B1
(45) Date of Patent: Jun. 5, 2001

(54) CONTAINMENT STRUCTURE AND METHOD OF MANUFACTURE THEREOF

(75) Inventors: P. John Fitzpatrick; David G. Stenning; James A. Cran, all of Calgary (CA)

(73) Assignee: Wild Rose Holdings Ltd., Grand Caymen Island (KN)

( * ) Notice: Subject to any disclaimer, the term of this patent is extended or adjusted under 35 U.S.C. 154(b) by 0 days.

(21) Appl. No.: 09/497,703

(22) Filed: Feb. 4, 2000

(51) Int. Cl.[7] ..... B63B 25/02
(52) U.S. Cl. ..... 114/74 A; 220/901; 137/256
(58) Field of Search ..... 114/72, 74 R, 114/74 A, 74 T, 220, 256; 220/89, 901; 137/1, 256, 263, 571

(56) References Cited

U.S. PATENT DOCUMENTS

| | | | |
|---|---|---|---|
| 5,803,005 | 9/1998 | Stenning et al. | 114/72 |
| 5,839,383 | 11/1998 | Stenning et al. | 114/72 |
| 6,003,460 | 12/1999 | Stenning et al. | 114/72 |

FOREIGN PATENT DOCUMENTS

| | | | |
|---|---|---|---|
| 2198358 | 10/1996 | (CA) | B63B/35/00 |
| 2259429 | 9/1997 | (CA) | F17C/1/00 |
| WO97/16678 | 10/1996 | (WO) | F17C/1/00 |
| WO98/14362 | 9/1997 | (WO) | B63B/25/00 |
| WO99/19203 | 10/1997 | (WO) | B63B/25/00 |

*Primary Examiner*—Jesus D. Sotelo
(74) *Attorney, Agent, or Firm*—Anthony R. Lambert

(57) ABSTRACT

A marine gas storage and transport system formed of small diameter steel pipe, which is coiled and stacked in a specific manner. The system is suitable for use on top of a barge or inside the holds of a ship, when contained within a secondary containment system. The specific manner in which the pipe is coiled is such that about 97% of the total length of pipe coiled may be described by constant curvature or pure circles. Additionally these circles lie directly on top of one another about 94% of the time and vertical stacking stresses are minimized. Only about 6% of the pipe is involved in crossover geometry. This method, of about 97% circular coiling, combined with about 3% transitional coiling results in a continuous length of pipe that nests easily, provides greatly reduced contact stresses and is very economic to construct due to its ease of nesting and it's long lengths of constant curvature. Descriptions of the marine transport system or the coil containment system are not included since they are described in related patents.

20 Claims, 7 Drawing Sheets

FIG. 5

```
 10 CLS:SCREEN 9:COLOR 1,2
 20 XC=5:T1=19:T2=200:T3=10:T4=14:T6=.01:T7=.2
 30 REM XC IS X VALUE OF CENTRE OF CIRCLE. T1 & T2 ARE X AND Y MULTIPLIERS.
    PRINT SCREEN IS TRUE SCALE WHEN BOTH ARE EQUAL. NOT SO FOR COMP SCREEN.
 40 REM T2 IS SHIFT VALUE FOR X & T3 IS SHIFT VALUE FOR Y. T6 IS STEP VALUE
    FOR ALL EXCEPT DOTTED UNDERNEATH CIRCLE. THIS IS T7.
 50 REM FOLLOWING CODE DESCRIBES LEFT HAND CIRCLES
 60 FOR R1=5 TO 25 STEP .5
 70 FOR X=-R1+5 TO 2 STEP T6
 80 Y=SQR(R1^2-(X-XC)^2)  <------ 32
 90 PSET(X*T1+T2,Y*T4-T3)
100 NEXT
110 NEXT
120 REM FOLLOWING CODE DESCRIBES RIGHT HAND CIRCLES
130 FOR R1=6! TO 25 STEP .5
140 FOR X=5+R1 TO 8 STEP -T6
150 Y=SQR(R1^2-(X-XC)^2)  <------ 32
160 PSET(X*T1+T2,Y*T4-T3)
170 NEXT
180 NEXT
190 REM FOLLOWING CODE DESCRIBES TRANSITION ZONE EQUATIONS. AT EACH END THE
    BOUNDARY CONDITIONS OF POSITION AND SLOPE ARE SUBSTITUTED AND THE FOUR
    CONSTANTS A1, A2, A3, AND A4 ARE SOLVED BY GAUSSONIAN REDUCTION.
200 REM R1=15
210 FOR R1=5 TO 24 STEP .5
220 FOR XG=+2 TO 8 STEP T6
230 X1=2:X2=8:Y1=SQR(R1^2-(X1-XC)^2:Y2=SQR((R1+1!)^2-(X2-XC)^2)
240 D=.0001:DY1=-(X1-XC)/SQR(R1^2-(X1-XC)^2:DY2=-(X2-XC)/ SQR((R1+1!)^2-(X2-
    XC)^2)
250 C1=Y1:C2=X1^D:C3=X1^(D+1):C4=X1^(D+2):C5=X1^(D+3)
260 D1=DY1:D2=D*X1^(D-1):D3=(D+1)*X1^D:D4=(D+2)*X1^(D+1):D5=(D+3)*X1^(D+2)
270 E1=Y2:E2=X2^D:E3=X2^(D+1):E4=X2^(D+2):E5=X2^(D+3)
280 F1=DY2:F2=D*X2^(D-1):F3=(D+1)*X2^D:F4=(D+2)*X2^(D+1):F5=(D+3)*X2^(D+2)
290 G1=(C1-D1*C2/D2):G2=(C3-D3*C2/D2):G3=(C4-D4*C2/D2):G4=(C5-D5*C2/D2)
300 H1=(C1-E1*C2/E2):H2=(C3-E3*C2/E2):H3=(C4-E4*C2/E2):H4=(C5-E5*C2/E2)
310 J1=(C1-F1*C2/D2):J2=(C3-F3*C2/F2):J3=(C4-F4*C2/F2):J4=(C5-F5*C2/F2)
320 K1=(G1-H1*G2/H2):K2=(G3-H3*G2/H2):K3=(G4-H4*G2/H2)
330 L1=(G1-J1*G2/J2):L2=(G3-J3*G2/J2):L3=(G4-J4*G2/J2)
340 M1=(K1-L1*K2/L2):M2=(K3-L3*K2/L2)
350 A4=M1/M2:A3=(L1-L3*A4)/L2:A2=(J1-J4*A4-J3*A3)/J2:A1=(F1-F3*A2-F4*A3-
    F5*A4)/F2
360 YG=A1*XG^D+A2*XG^(D+1)+A3*XG^(D+2)+A4*XG^(D+3)  <------ 28
370 PSET(XG*T1+T2,YG*T4-T3)
380 REM PRINT XG;YG
390 NEXT
400 NEXT
410 REM FOLLOWING CODE DESCRIBES DOTTED UNDERLYING CIRCLES.
420 FOR R1=6 TO 25 STEP .5
430 FOR X=2 TO 8 STEP T7
440 Y=SQR(R1^2-(X-XC)^2):COLOR 1,2
450 PSET(X*T1+T2,Y*T4-T3)
460 NEXT
470 NEXT
```

30

CONTAINMENT STRUCTURE AND METHOD OF MANUFACTURE THEREOF

FIELD OF THE INVENTION

This invention relates to containment structures and methods of manufacture thereof, particularly for the marine transport and storage of compressed natural gases.

BACKGROUND OF THE INVENTION

The invention relates particularly to the marine gas transportation of compressed gas. Because of the complexity of existing marine gas transportation systems significant expenses are ensued which render many projects uneconomic. Thus there is an ongoing need to define storage systems for compressed gas that can contain large quantities of compressed gas, simplify the system of complex manifolds and valves, and also reduce construction costs. This specific system, which is a unique development of the more general systems described in the above patent application, purports to do all three.

SUMMARY OF THE INVENTION

In an aspect of the invention, there is provided a containment structure comprising a continuous coiled pipe formed in at least a first layer and a second layer lying on top of the first layer, coiled pipe in the second layer lying directly on top of and aligned with the coiled pipe in the first layer, apart from a first transition zone in which coiled pipe in the first layer rises to form part of the second layer and cross coiled pipe in the first layer.

In a further aspect of the invention, there is provided a method of forming a containment structure, comprising forming a continuous coiled pipe in at least a first layer and a second layer lying on top of the first layer, with coiled pipe in the second layer lying directly on top of and aligned with the coiled pipe in the first layer, apart from a first transition zone in which coiled pipe in the first layer rises to form part of the second layer and cross coiled pipe in the first layer.

In a further aspect of the invention, there is provided a containment structure comprising a continuous constant diameter coiled pipe formed in a single layer of alternating constant radius circle segments, in which each circle segment covers 360/n degrees, with each succeeding circle segment being 1/n pipe diameters greater in radius than a preceding circle segment, where n is greater than 1.

The containment structure of the invention is particularly suited for use as a gas storage system, particularly adapted for the transportation of large quantities of compressed gas on board a ship (within its holds, within secondary containers) or on board a simple barge (above or below its deck, within secondary containers). The coiled pipe is preferably formed of long, primarily circularly curved sections of small diameter steel pipe. The pipe, generally smaller than 8 inches may be coiled in a specific manner within a simple circular container.

In one embodiment, the diameter of the container is about 50 feet and it is about 10 feet high. Approximately 10 miles of pipe or more may be coiled and stacked within the container. The coiling is continuous and there are no valves or interruptions from the start to the end of the coil.

In one aspect of the invention, the pipe may be viewed as starting at the inside of the bottom layer. It spirals outwards by means of constant curvature constant radius segments, preferably semi-circles, which abruptly change their curvature and also their centers of curvature by a small percentage of their gross curvature and their radii respectively. By this means programming and quality control on the bending rollers are kept constant and simple for relatively long periods of time. When the pipe reaches the outside of the container it is forced by the geometry of the container to climb up to the second layer and then start an inwards spiral. After two semi-circular arcs the pipe follows a transition curve which takes it across two pipes immediately below, in a distance of about 12 pipe s. This distance is relatively short and thus vertical stacking stresses at crossover points are minimized. By transitioning two pipes beneath and then by spiraling back out one of the pipe, immediately above the first and subsequent odd layers, a net inwards spiral gain of one pipe is thus achieved. Thus the odd layers spiral outwards and the even layers spiral inwards. When the pipe reaches the inside of the circular container, in even layers, it rises to the odd layers above and its projected plan geometry becomes the same as the geometry of the first layer. Thus the odd layers are composed entirely of semicircles and the even layers are composed of semicircles with very short transition zones.

The invention includes both the containment structure produced by the layered coiled pipes, which lie directly upon each other except for the transition zone, and the method of coiling the pipes to obtain the structure.

The gas storage system of this invention has many advantages, some of which are noted in earlier patents filed by two of the inventors (U.S. Pat. Nos. 5,839,383and 5,803,005). First, the pipe is small and the severity of failure is greatly reduced. Possibly also the probability of failure is also reduced. Second, the technology for the production of long straight and subsequently constantly curved pipe is well known and inexpensive. Third, the system is continuously inspectable by means of an internal pig. Fourth, complicated curved features are absent for about 97% of the coiled length. Fifth, the coiled layout and vertical stacking arrangement reduce gravitational stresses and ship motion stresses to a small fraction of the pipe capacity, even when stacked about 20 to 30s high. All of these features lead to great cost reductions.

Other features and advantages of the invention become apparent when viewing the drawings and upon reading the detailed description.

BRIEF DESCRIPTION OF THE DRAWINGS

Preferred embodiments of the invention will now be described, with reference to the drawings, by way of illustration only and not with the intention of limiting the scope of the invention, which like numerals denote like elements and in which:

FIG. 5 is a reproduction of the computer program used to define exactly the geometry, lines and co-ordinates of FIG. 1B; more particularly the mathematical reduction mechanism used to define the transition curves.

DETAILED DESCRIPTION OF PREFERRED EMBODIMENTS

Figure 1:
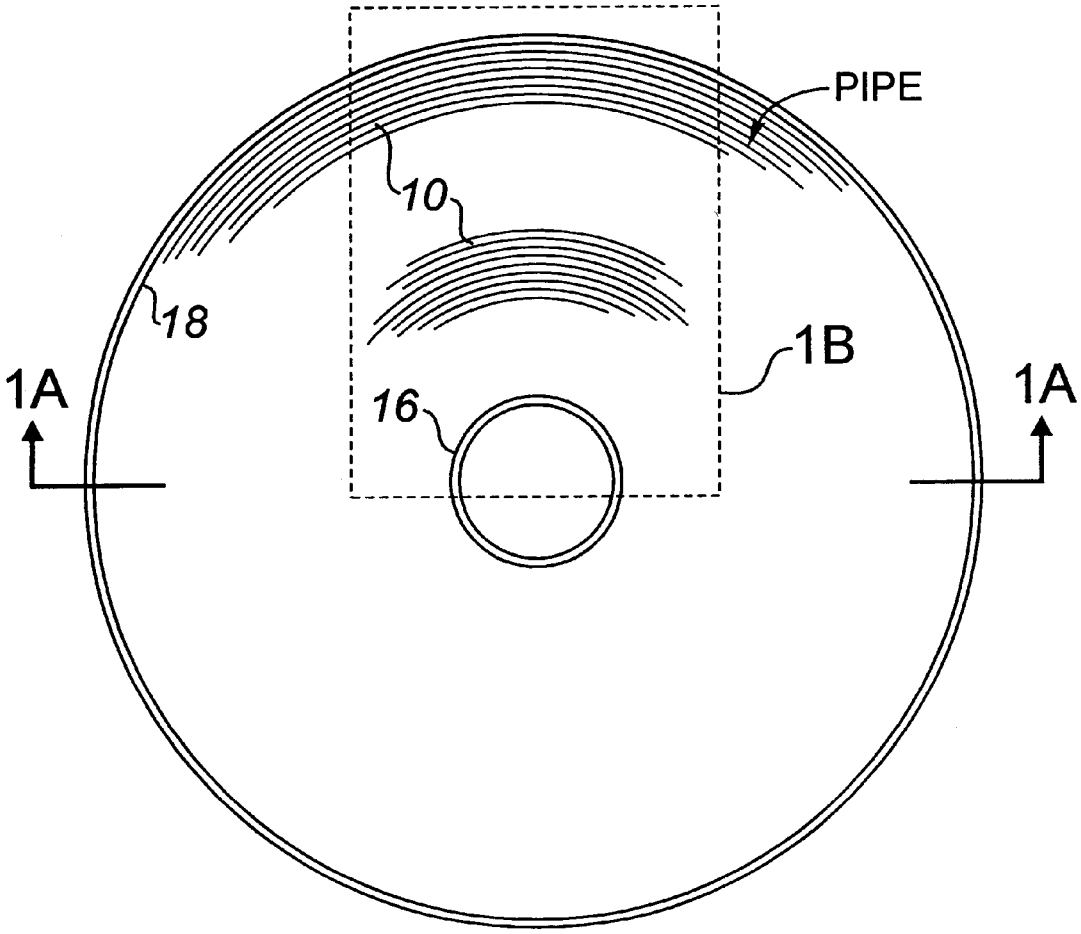
FIG. 1 is a top plan view of layers of pipe according to the invention.
Figure 1A:
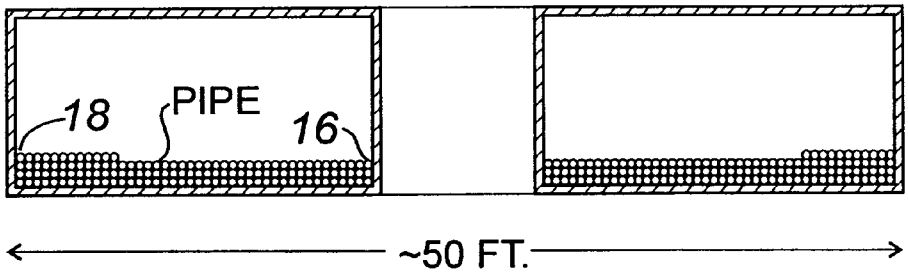
FIG. 1A is a section through the layers of pipe of FIG. 1.

Referring now to the drawings, where corresponding similar parts are referred to by the same numerals throughout the different figures, the preferred embodiments are now described. It is also understood that the material employed to make the pipe and its connections will be ductile and not brittle at the proposed operating temperatures. The pipe and its connections may be fabricated from normal grade steel typically X70. The word comprising is inclusive and does not exclude other features being present. The indefinite article"a " does not exclude more than one of an element being present. The radius of the coiled pipe generally refers to the radius of the coil. When the cross-sectional diameter of the pipe is referred to, it is referred to as the diameter of the pipe. It will be understood that a continuous coiled pipe will be made of pipes welded together to make it continuous.

Figure 1B:
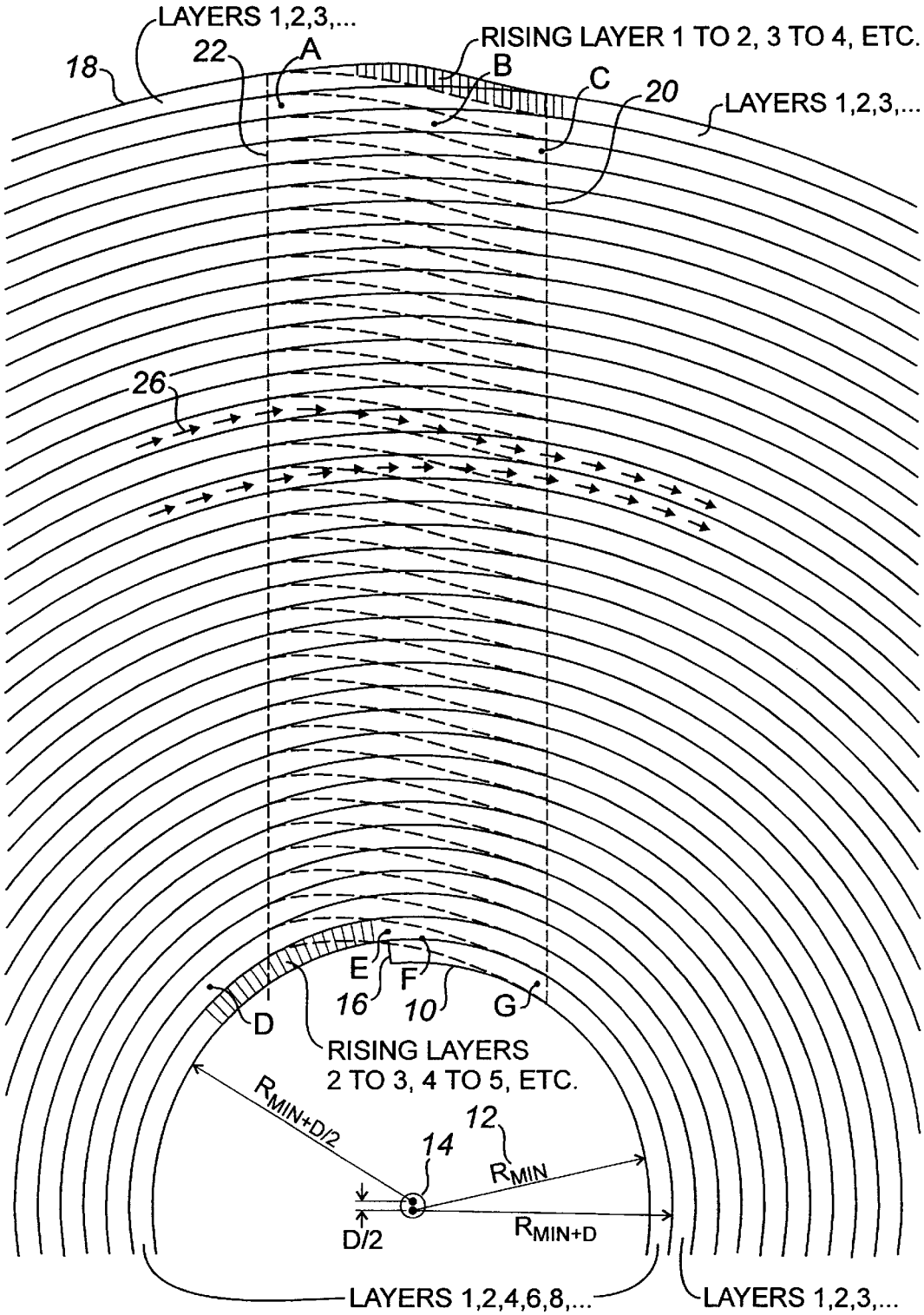
FIG. 1B shows a plan layout of the bottom two layers of the proposed specific coiling system.

FIG. 1B depicts a plan view of portion of the bottom two layers of a generally circular continuous length of small pipe. Other pipe layers subsequently lie on these bottom layers and their plan projected lines fall either on the first layer, shown solid lined if the layer is odd numbered, or on the dotted transition lines and the solid lines if the layer is even numbered. The coiled pipe of a subsequent layer lies directly upon and aligned with the coiled pipe of a previous layer, except in the transition zone to be described. There is thus a linear contact zone between pipe in succeeding layers that distributes the weight of the pipe in an optimal manner. The first layer 10 begins with a small pipe with internal radius $R_{min}$ 12 and describes a half circle. The center of curvature is then abruptly shifted by half the pipe and the radius is also increased by half a pipe. This results in bringing the inside of pipe exactly tangential as shown at 16 to the outside of the start of the pipe spiral 10. Thus the path of the pipe has moved out one pipe diameter in one sweep of 360 degrees by the use of two specific half circles. This reduces the complexity of input to the bending rollers, which impart the prescribed bending curvature, to two constants. The bottom layer proceeds outwards in this manner with ever increasing half circles. When the pipe reaches the outside of the container 18 it is forced to rise up and land directly on top of the outside of layer one 20 and then it continues around as layer two until it reaches the start of the transition zone 22. Then by the path dictated by a prescribed mathematical formula, as outlined in FIGS. 2, 3 and. 5, it leaves the pipe directly underneath in a horizontally tangential fashion and joins tangentially and immediately above the pipe beneath, but some two pipe diameters inwards. This transition shown A B C is accomplished within a distance of about 12 pipe diameters and receives point crossover support at the point B.

This short transition length means that only 3% of the coiling has continuously changing curvature. The arrows 26 show how by moving inwards by two pipe diameters and by moving back outwards by one that even layers have a net inwards spiral translation even though they lie directly on top of and aligned with an outwards spiral for about 94% of the time. The following are some summary statements relating to FIG. 1:

Odd layers spiral outwards and even layers spiral inwards.

Odd layers have no transition zones.

Even layers have a transition zone equal to approximately 12 pipe diameters.

About 97% of the coiling uses pure circular curvature.

Outside of the transition zone, which represents about 94% of the total coiling, all pipes in each layer, (about 40 or more layers), lie directly on top of one another.

Throughout the entire coiling system, both inside and outside of the transition zone, the radius of curvature is greater than about 11 diameters. This is true also where layers change from one to another. Hence the maximum bending strain does not exceed a certain prescribed limit of approximately 5%.

Where a lower layer rises to a higher layer, at the outside and at the inside, the transition equation (in FIG. 5) is also used. However it is combined with two short reverse circular arcs joined by a tangent, in the vertical plane to accommodate the rise as well as the lateral translation.

At the outside, rising layers go from odd to even and at the inside rising layers go from even to odd.

Every 180 degrees, in the odd layers, the radius of curvature changes abruptly by an amount equal to one half-pipe diameter. Additionally the center of curvature changes by an equal amount, thus permitting a total radial translation of one pipe diameter after 360 degrees.

Figure 2:
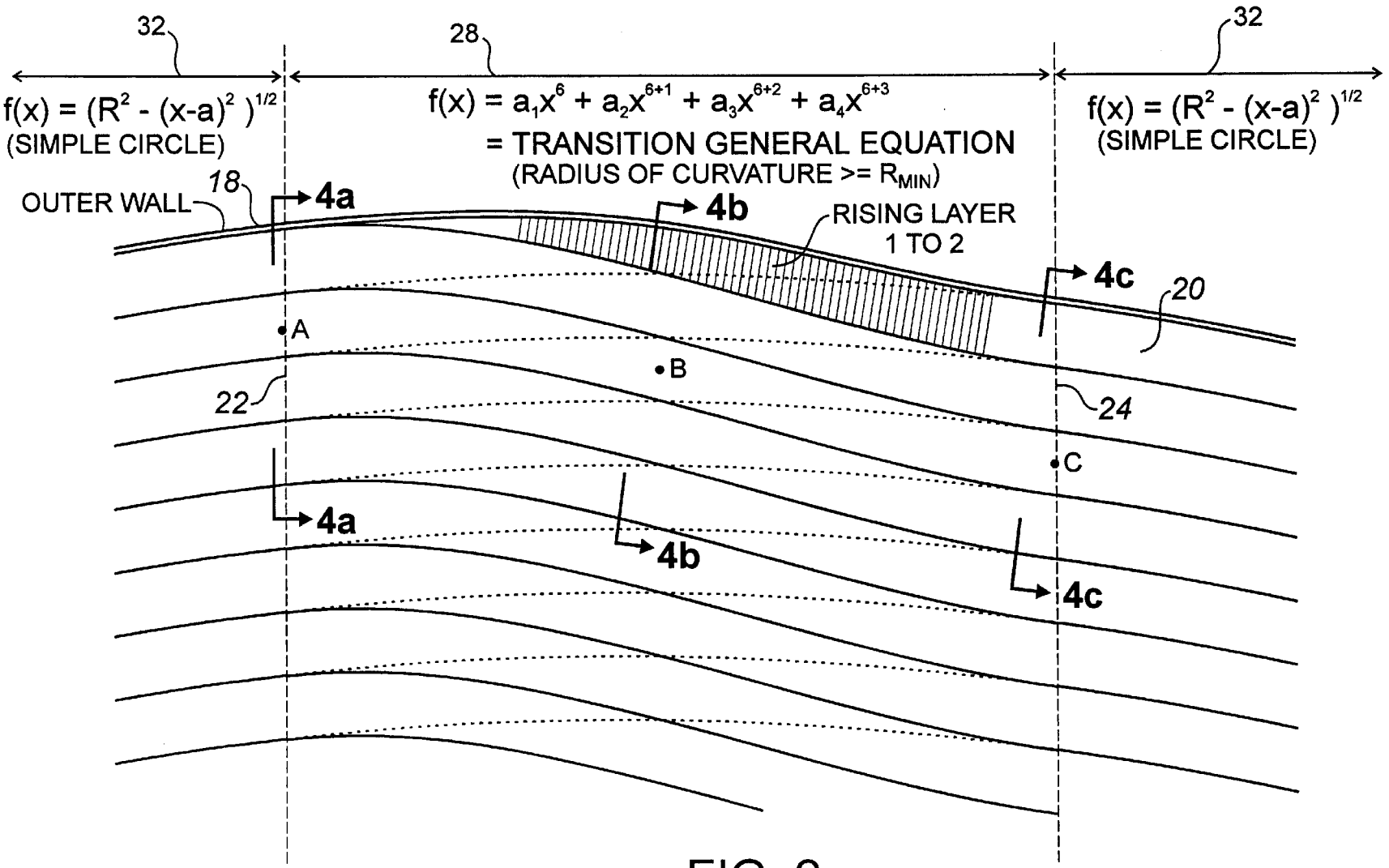
FIG. 2 is an enlarged plan view of the outer transition portion of FIG. 1.

The references to even and odd layers can be interchanged by inserting the transition zone in the lowermost layer, but this is slightly disadvantageous since the bottom most layer will then suffer greater stresses on the lowest cross-over points than if they were in the second layer. FIG. 2 is an enlargement of the outer portion of the transition area. The basic transition generalized equation 28 is quoted and the mechanics of the solution 30 is depicted in FIG. 5. Depicted in FIG. 2 also is the simple function 32 that describes the pure half circles that make up 97% of the coiling geometry. Position cross-sections A B C are shown and these can be tracked later in FIGS. 4A–4G to complete the three-dimensional picture. FIG. 2 also shows the outer wall 18 of the container and it's accompanying transitional nature.

Figure 3:
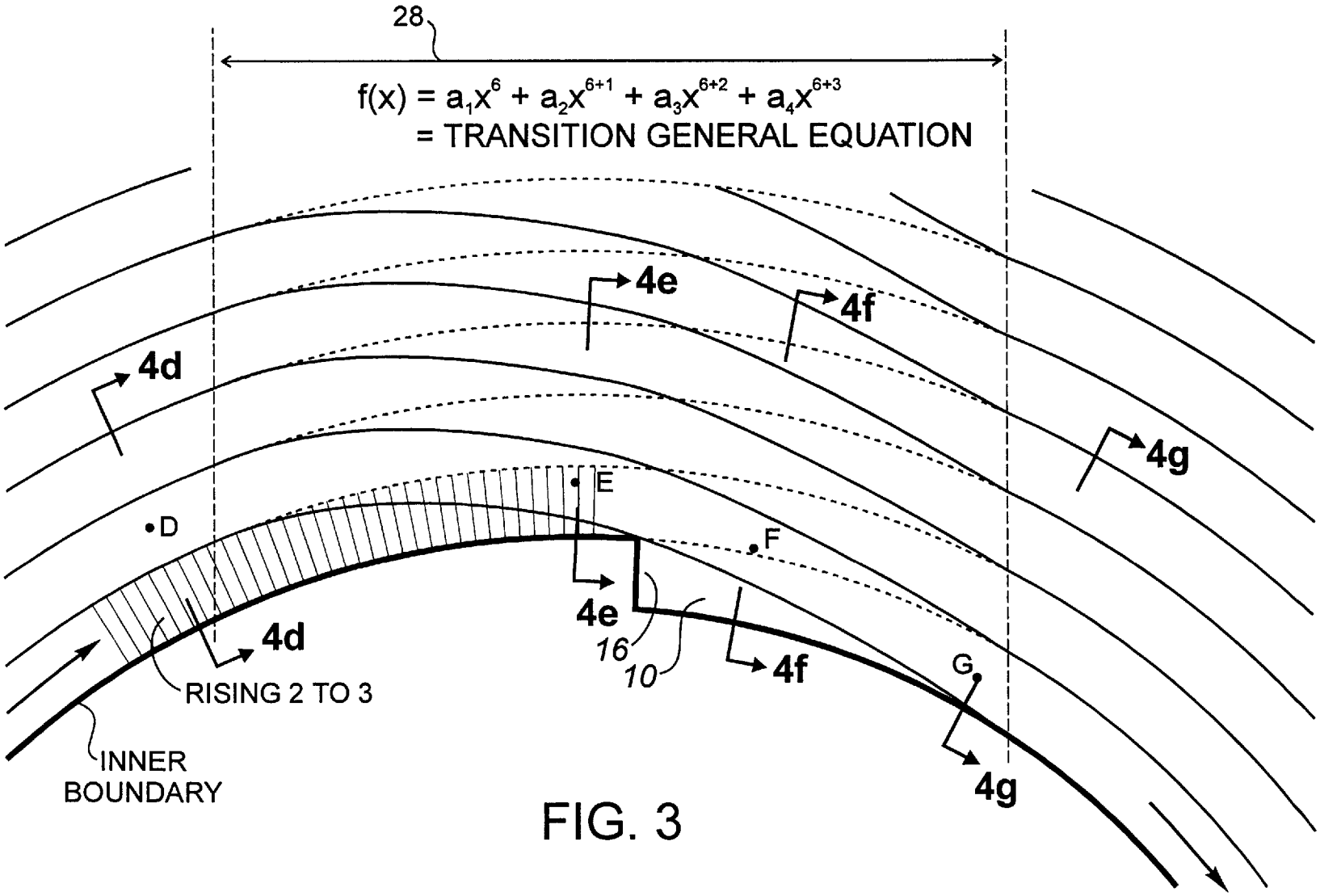
FIG. 3 is an enlarged plan view of the inner transition portion of FIG. 1.
Figure 4A:
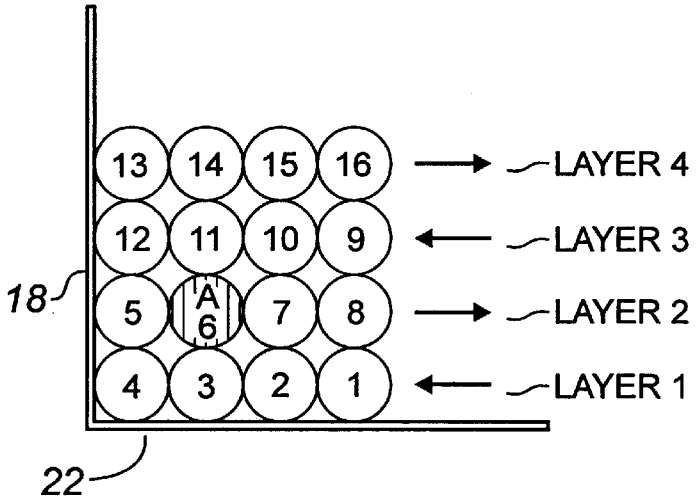
FIGS. 4A–4G are a series of cross-sections of sections marked on FIGS. 1,2 and 3.
Figure 4B:
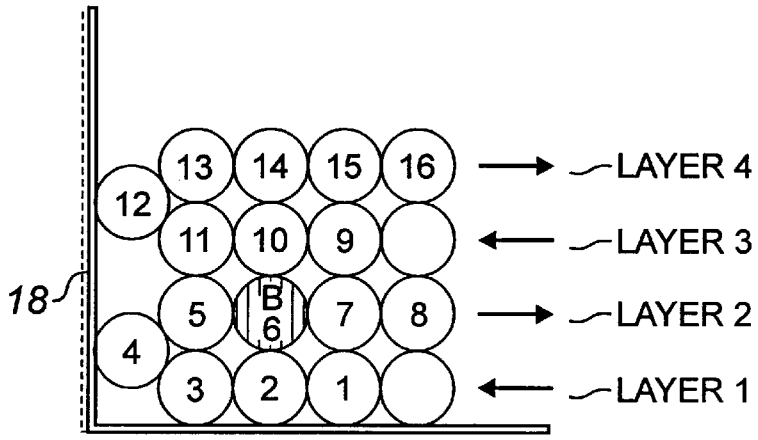
Figure 4C:
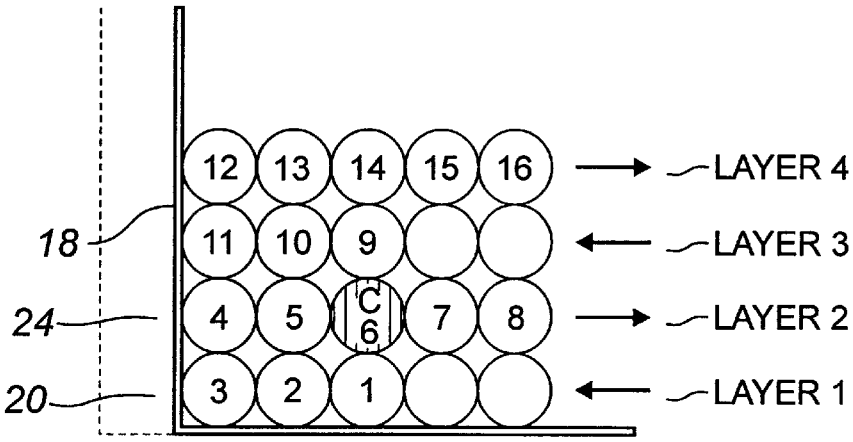
Figure 4D:
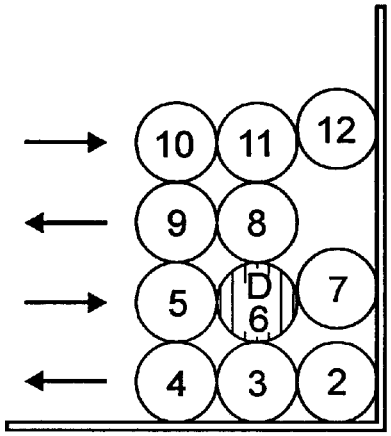
Figure 4E:
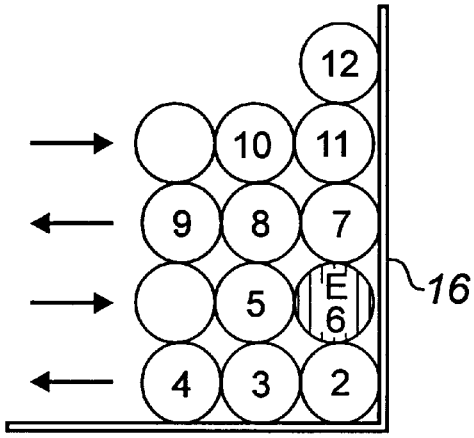
Figure 4F:
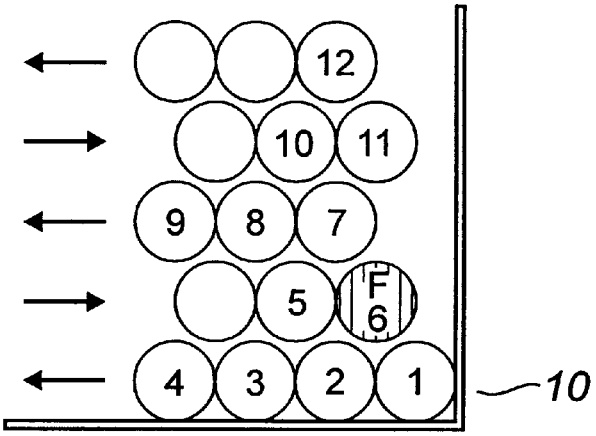
Figure 4G:
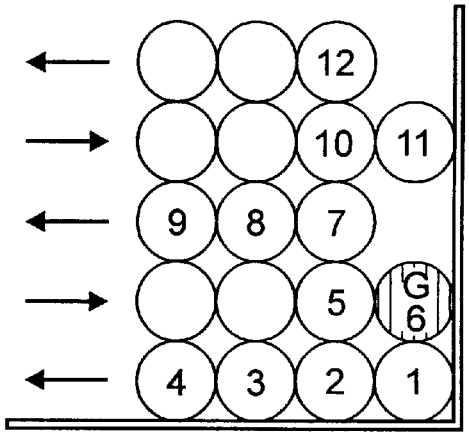

FIG. 3 is an enlargement of the inner portion of the transition area. The section locations D E F G are shown and later depicted in FIG. 4. The generalized transition function 28 is exactly the same as in FIG. 2 however the specific values of the constants are different numerically. This numerical difference results in transition curves that do not have reverse curvature, as is the case with the outer transition curves.

FIGS. 4A–4G depict the bottom 4 or 5 layers at the inside and outside of the coil container vessel. Tracking pipe number 6 for instance depicts the paths A B C and D E F G shown in the first three figures. Tracking of pipe number 4 in sections A, B and C shows how the first layer changes into the second layer. Here it can be seen why only odd layers rise at the outside. Similarly it can be observed that only even layers rise at the inside.

A more detailed description of FIGS. 4A–4G now follows. The start of the pipe coil can be seen in section F at the pipe with the number 1 in its center. Section G immediately above shows pipe number 1 and this portion of the pipe is placed shortly after that in section F. The next portion of pipe placed is seen in section D and is numbered 2 in its center. After that the next portion is in section E and is shown numbered 2 in its center. Thus the sequence of how the pipe is placed at the start of the bottom or first layer can be described as F1, (meaning section F, pipe number 1), G1, D2, E2, F2, G2, D3, E3, F3, G3, D4, E4, F4, G4. This procedure is continued outwards one pipe diameter at a time until position A1 in section A is reached. The finishing placement sequence for the first layer can be described as A1, B1, C1, A2, B2, C2, A3, B3, C3, and A4. Thus this describes the placement of the first layer which winds outwards. The pipe then rises up and begins to move inwards in the second layer. The sequence is given by B4, C4, A5, B5, CS, A6, B6, C6, A7, B7, C7, A8, B8, and C8. This procedure is continued inwards one pipe diameter at a time until position D5 in section D is reached. The finishing 10 placement sequence for the second layer can be described as D5, E5, F5, G5, D6, E6, F6, G6,. The pipe then starts to rise up at D7 and reaches the third layer at E7, whereupon the outwards moving sequence becomes F7, G7, D8, E8, F8, G8, D9, E9, F9, G9. The rest of the coiling continues in a similar fashion outwards and inwards following the sequence A9, B9, C9, A10, B10, C10, A11, B11, C11, A12, B12, C12, A13, B13, C13, A14, B14, C14, A15, B15, C15, A16, B16,C16 . . . D10, E10, F10, G10, D11, E11, F11, G11, D12, E12, F12 and G12. Only the first five layers are represented in FIG. 4. The pattern repeats itself for as many layers as are required, typically 20 or 30.

FIG. 5 depicts a brief program, written in basic language, which describes the geometry shown in the first three figures. The print functions are graphical but the output can be easily expressed in a numerical co-ordinate system. The principal feature of the program 30 between lines 190 and 400 is the mathematical description of how the constants for the transition equation are solved. The solution method is essentially a variation of a standard Gaussonian reduction method. The actual general equation 28 is unique to this process of coiling. Also the exponent (D, in line 240) used in the equation is unique in that it can be used as a tuning parameter to provide almost perfect nesting of the pipe in the transition zone.

It will be thus seen that the invention provides:

A specific method or system of coiling small diameter pipe having a long continuous length of small diameter pipe approximately 10 miles (approximately 5 to 8inches in diameter).

About 97% of the pipe is bent to a constant curvature over intervals of approximately 180 degree arcs (such simplicity of constant curvature greatly reduces the cost of construction).

A unique transition method (for about 3% of the coil length) enables about 94% of the pipe to lie directly beneath or on top of another pipe. Such a stacking pattern greatly reduces local bending and crossover stresses and thus reduces the overall wall thickness of the pipe or increases the permissible stacking height in each container.

A method of coiling pipe that continuously spirals outwards and inwards by the use of stepped constant curvature for approximately 97% of it's total length.

A mathematical method for describing the specific coiling geometry.

Although the coils are shown in constant radius half circles, these could be segments of 360/n degrees, with each segment increasing in diameter 1/n pipe diameters, where n is greater than 1, but each increase of n over 2 increases the number of pipe bend settings and is not preferred. In the containment structure produced by this method, coiled pipe in any kth segment abuts coiled pipe in the k+nth segment for each kth segment except segments forming an outer boundary of the containment structure, to thus form a gapless structure. Although an embodiment has been shown in which the transition zone occupies 12 pipe diameters, advantages are still believed to be obtained when the transition zone occupies less than 50 pipe diameters.

The coiled pipe forms a containment structure that will normally be provided with valves 37 at either end of the pipe. The coiled pipe is suitable for the containment of gas.

The coiled pipe is preferably enclosed within the container 18, which is preferably sealed to provide a secondary containment structure, and equipped with leak detection equipment.

The invention has now been described with reference to the preferred embodiments and substitution of parts and other modifications will now be apparent to persons of ordinary skill in the art. Accordingly, the invention is not intended to be limited except as provided by the appended claim.

The embodiments of the invention in which an exclusive property of privilege is claimed are defined as follows:

1. A containment structure comprising:

a continuous coiled pipe formed in at least a first layer and a second layer lying on top of the first layer, coiled pipe in the second layer lying directly on top of and aligned with the coiled pipe in the first layer, apart from a first transition zone in which coiled pipe in the first layer rises to form part of the second layer and cross coiled pipe in the first layer.

2. The containment structure of claim 1 in which the first transition zone occupies less than 6% of the area of a layer.

3. The containment structure of claim 2 in which the first transition zone occupies less than 50 pipe diameters.

4. The containment structure of claim 3 in which coiled pipe in the first layer spirals in a series of constant radius segments.

5. The containment structure of claim 4 in which coiled pipe in the first layer is coiled in alternating first and second half-circles, with each second half-circle being a half pipe diameter greater in radius than a first half-circle.

6. The containment structure of claim 2 in which there are alternating odd and even numbered layers of coiled pipe, and coiled pipe in even numbered layers rises in a second transition zone to form an odd numbered layer.

7. The containment structure of claim 6 in which, in the first transition zone, coiled pipe in even numbered layers alters its radius from the center of curvature by two pipe diameters.

8. The containment structure of claim 7 in which the coiled pipe has a lowermost layer that is an odd numbered layer.

9. The containment structure of claim 7 in which the coiled pipe has a lowermost layer that is an even numbered layer.

10. The containment structure of claim 1 in which the coiled pipe is formed within a container having an inner wall and an outer wall.

11. The containment structure of claim 10 in which the inner wall is stepped.

12. The containment structure of claim 1 in which the coiled pipe is equipped with valves for containing fluid.

13. The containment structure of claim 12 in which the coiled pipe is used for the storage of compressed gas.

14. A method of forming a containment structure, comprising the steps of:

forming a continuous coiled pipe in at least a first layer; and forming a second layer lying on top of the first layer, by placing coiled pipe in the second layer lying directly on top of and aligned with the coiled pipe in the first layer, apart from a first transition zone in which coiled pipe in the first layer rises to form part of the second layer and cross coiled pipe in the first layer.

15. The method of claim 14 in which coiled pipe is radially offset by two pipe diameters through the first transition zone.

16. The method of claim 14 further including forming a third layer by creating a second transition zone in which coiled pipe in the second layer rises to start a third layer.

17. A containment structure comprising:

a continuous constant diameter coiled pipe formed in a single layer of alternating constant radius circle segments, in which each circle segment covers 360/n degrees, with each succeeding circle segment being 1/n pipe diameters greater in radius than a preceding circle segment, where n is greater than 1.

18. The containment structure of claim 17 in which n is 2.

19. The containment structure of claim 17 in which coiled pipe in any kth segment abuts coiled pipe in the k+nth segment for each kth segment except segments forming an outer boundary of the containment structure, to thus form a gapless structure.

20. The containment structure of claim 17 in which succeeding circle segments have offset centers of curvature.

* * * * *

UNITED STATES PATENT AND TRADEMARK OFFICE

CERTIFICATE OF CORRECTION

PATENT NO. : 6,240,868 B1
DATED : June 5, 2001
INVENTOR(S) : Fitzpatrick et al.

It is certified that error appears in the above-identified patent and that said Letters Patent is hereby corrected as shown below:

Column 1,
Line 5, insert -- This application claims priority of Canadian Application No. 2,283,007 filed September 22, 1999. --

Signed and Sealed this

Twenty-seventh Day of July, 2004

JON W. DUDAS
*Acting Director of the United States Patent and Trademark Office*